US008646746B2

(12) United States Patent
Boese et al.

(10) Patent No.: US 8,646,746 B2
(45) Date of Patent: Feb. 11, 2014

(54) CONCRETE FORM BRACE HAVING ARTICLE SECURING MECHANISM

(71) Applicant: Step Ahead Tools LLC, Big Fork, MT (US)

(72) Inventors: Jason D. Boese, Big Fork, MT (US); Dwight Lamm, Big Fork, MT (US); Darryl Byle, Big Fork, MT (US); Todd Charlebois, Big Fork, MT (US)

(73) Assignee: Step Ahead Tools LLC, Bigfork, MT (US)

( * ) Notice: Subject to any disclaimer, the term of this patent is extended or adjusted under 35 U.S.C. 154(b) by 0 days.

(21) Appl. No.: 13/717,522

(22) Filed: Dec. 17, 2012

(65) Prior Publication Data

US 2013/0104482 A1 May 2, 2013

Related U.S. Application Data

(63) Continuation of application No. 13/531,391, filed on Jun. 22, 2012, now Pat. No. 8,348,225, which is a continuation of application No. 12/568,540, filed on Sep. 28, 2009, now Pat. No. 8,231,100, which is a continuation-in-part of application No. 11/107,212, filed on Apr. 15, 2005, now abandoned.

(51) Int. Cl.
*E04G 17/12* (2006.01)

(52) U.S. Cl.
CPC ..... *E04G 17/12* (2013.01)
USPC ..... 249/216; 249/4; 249/34

(58) Field of Classification Search
USPC ..... 249/4, 5, 34, 91, 93, 213, 216
See application file for complete search history.

(56) References Cited

U.S. PATENT DOCUMENTS

| | | | | | |
|---|---|---|---|---|---|
| 972,618 | A * | 10/1910 | Haage | 249/22 |
| 1,126,190 | A * | 1/1915 | Fuehrer | 249/214 |
| 1,708,634 | A * | 4/1929 | Rees | 249/218 |
| 1,784,329 | A * | 12/1930 | Dirk Bierhaalder | 249/45 |
| 2,442,962 | A * | 6/1948 | Rumble | 249/38 |
| 3,652,046 | A * | 3/1972 | Hughes | 248/205.1 |
| 3,722,849 | A * | 3/1973 | Luyben | 249/219.1 |
| 5,065,561 | A * | 11/1991 | Mason | 52/309.12 |
| 5,207,931 | A * | 5/1993 | Porter | 249/210 |
| 5,224,799 | A * | 7/1993 | Parker | 405/229 |
| 5,390,459 | A * | 2/1995 | Mensen | 52/426 |
| 5,399,050 | A * | 3/1995 | Jacobus | 405/229 |
| 5,937,604 | A * | 8/1999 | Bowron | 52/426 |
| 5,992,114 | A * | 11/1999 | Zelinsky et al. | 52/426 |
| 6,308,484 | B1 * | 10/2001 | Severino | 52/426 |
| 6,314,697 | B1 * | 11/2001 | Moore, Jr. | 52/426 |
| 6,536,172 | B1 * | 3/2003 | Amend | 52/426 |
| 6,622,352 | B2 * | 9/2003 | Herron | 24/563 |
| 6,629,394 | B1 * | 10/2003 | Trevino | 52/677 |
| 7,444,789 | B1 * | 11/2008 | Moore | 52/426 |
| 7,467,777 | B2 * | 12/2008 | Huber et al. | 249/214 |
| 2009/0260306 | A1 * | 10/2009 | Ebanks | 52/285.3 |

* cited by examiner

*Primary Examiner* — Michael Safavi
(74) *Attorney, Agent, or Firm* — Jean Kyle

(57) ABSTRACT

A brace for concrete forms employing first and second form elements includes at least one attachment member adapted and constructed to secure the brace to at least one of the form elements. A span member is connected to the at least one attachment member, and has a length sufficient to hold the first and second form elements apart. At least one article securing mechanism secures the article associated with the concrete form to the brace.

24 Claims, 9 Drawing Sheets

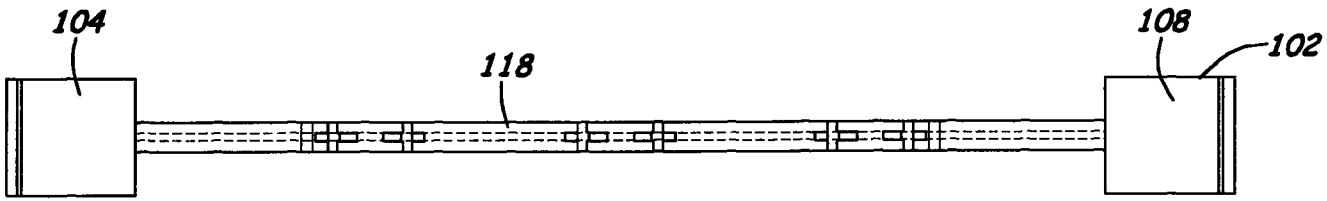
Fig. 16
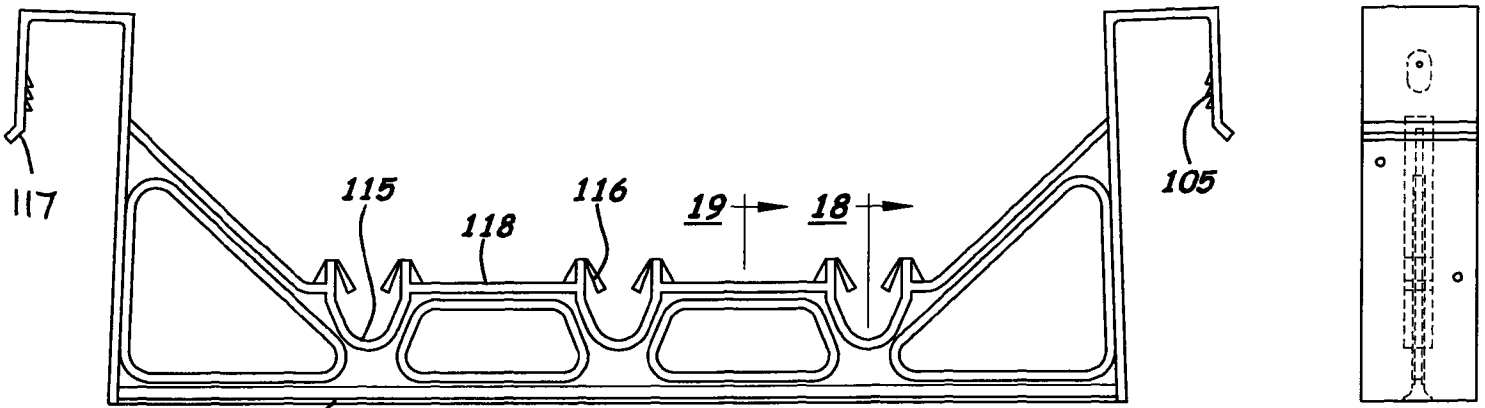
Fig. 15
Fig. 17

CONCRETE FORM BRACE HAVING ARTICLE SECURING MECHANISM

CROSS-REFERENCE TO RELATED APPLICATIONS

This application is a continuation of U.S. patent application Ser. No. 13/531,391, filed Jun. 22, 2012, which is a continuation of U.S. application Ser. No. 12/568,540, filed Sep. 28, 2009, now U.S. Pat. No. 8,231,100 B2, issued Jul. 31, 2012, which is a continuation-in-part of U.S. patent application Ser. No. 11/107,212, filed Apr. 15, 2005, now abandoned. The disclosures of these application are hereby incorporated by reference in their entirety, including all figures, tables and drawings.

FIELD OF THE INVENTION

The present invention relates generally to building construction, and particularly to braces useful in erecting concrete forms.

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISC APPENDIX

Not applicable

BACKGROUND OF THE INVENTION

According to Lambert and MacDonald in their 1998 monograph titled "Reinforced Concrete History, Properties & Durability" (published by the Corrosion Prevention Association, Surrey, U.K.), the oldest known surviving concrete is to be found in the former Yugoslavia and was thought to have been laid in 5,600 BC using red lime as the cement. The first major concrete users were the Egyptians in around 2,500 BC and the Romans from 300 BC. The Romans found that by mixing a pink sand-like material which they obtained from Pozzuoli with their normal lime-based concretes they obtained a far stronger material. The pink sand turned out to be fine volcanic ash and they had inadvertently produced the first pozzolanic' cement. Pozzolana is any siliceous or siliceous and aluminous material which possesses little or no cementitious value in itself but will, if finely divided and mixed with water, chemically react with calcium hydroxide to form compounds with cementitious properties.

The Romans made many developments in concrete technology including the use of lightweight aggregates as in the roof of the Pantheon, and embedded reinforcement in the form of bronze bars, although the difference in thermal expansion between the two materials produced problems of spalling. It is from the Roman words 'caementum' meaning a rough stone or chipping and 'concretus' meaning grown together or compounded, that we have obtained the names for these two now common materials. Since the Romans had no powered cement mixers, they prepared small batches of concrete, and layered these batches either between wooden forms, or between facings of stone or brick already assembled. The Roman practice of pouring liquid concrete into wooden forms was rediscovered by the architect Bramante in the 15th century A.D., and incorporated into his early work on the Cathedral of St. Peter in Rome.

The use of concrete forms continued to progress, with important developments including iron-reinforced structures in the 18th century and steel-reinforced concrete as a building material of the mid-19th century. Reinforced concrete is often used in the construction of foundation footings, which provide a base for the foundation of a structure. Footings are typically fabricated by placing opposed form elements, spaced 8"-48" apart, around the design perimeter of the structure below the frostline. Form elements are usually elongate, and can be provided as removable wood or steel planks or permanently-installed foraminous drain elements. When planks are used, dimensional lumber, ranging from 1×4's and 2×4's through 1×12's and 2×12's, are often used for this purpose. The planks are usually secured together by a series of braces, such as 1×2's, to maintain the planks at a consistent distance from one another. Rebar or other reinforcing materials, such as mesh, can be secured within the form. Once the form is ready, concrete is poured to a desired depth and allowed to cure, after which the forms are removed.

Not surprisingly, various supports for concrete forms and associated systems have found their way into the patent literature. For example, U.S. Pat. No. 5,224,799 to Parker is directed to a permanently-installed form-drain including hollow, foraminous planks and connectors for joining two or more of the planks in a continuously arranged concrete barrier. The instant improvements include an adapter, which serves as a straight connector, grooved plank with interlocking stake, integral connector-stake and adapter-stake device and a tri-functional, generally rigid bracket and bracket-stake element, used to space and restrain/constrain the planks and/or to hold (support) reinforcement bars.

U.S. Pat. No. 6,314,697 to Moore sets forth a connector link component for use in an insulated concrete form system having first and second side panels and at least two connectors, each side panel having an exterior surface, an opposed interior surface, and at least one attachment coupling, the panels arranged in spaced parallel relationship with their interior surfaces and attachment couplings facing each other so that a cavity is formed therebetween, each connector having a first end and a distal second end, a first length extending therebetween, and a pair of opposed connector couplings, one connector coupling formed in the first end and the other connector coupling formed in the second end, so that the each connector coupling of each connector is adapted to engage one attachment coupling of the side panel, the connector link having a proximal end, having a first link coupling for engagement to the connector coupling of one connector of the concrete form system, a distal end, having a second link coupling for engagement to the connector coupling of one other connector of the concrete form system, and a substantially rigid body portion extending between the proximal end and the distal end of the connector link so that the connector link may be operatively engaged to the opposed connectors to structurally connect one attachment coupling on one side panel to one other attachment coupling on the other side panel.

U.S. Pat. No. 5,992,114 to Zelinsky deals with an apparatus for providing to an insulated, poured concrete wall which will result, when the concrete is poured, in a wall having internal and external insulation, drywall or other surface preparation connecting areas which are continuous of and extending the entire or selected lengths of the wall and apparatus for the provision of windows into the wall. The apparatus includes a pair of U-shaped lower members attachable to foundation footings to establish the sides of the wall and receive insulating or other material panels, a plurality of H-shaped intermediate members to receive insulating or other material panels which form the pouring area, a pair of U-shaped top members capping the uppermost tier of insulating or other material panels which members may also be utilized to form window openings, a plurality of tie bars frictionally attachable to the H members which provide cross connectors between tiers of the panel sections and U-shaped, corner members for both the bottom and top of the wall.

In U.S. Pat. No. 5,937,604 to Bowron, a concrete forms wall spacer is provided in the configuration of a truss having top and bottom horizontal frame members interconnected by angularly extending reinforcing struts. The top frame member is configured to rest upon the upper edges of a pair of spaced concrete form walls, and end portions of the top frame member are extended downward for abutment by the outer sides of the spaced concrete form walls, to define the desired spacing between the walls. Supported by the bottom frame member are a pair of spaced clip members each configured to removably support a pair of lengths of rebar which extend horizontally in opposite directions to other longitudinally spaced form wall spacers. A pair of vertically spaced rebar supports are mounted on the top and bottom frame members for frictionally securing a vertically extending length of rebar for forming a structural tie between a concrete footing and a vertically extending concrete wall. In a second embodiment of the invention, a plurality of pairs of vertically spaced rebar supports for vertical rebar are provided as detachable components.

U.S. Pat. No. 5,399,050 to Jacobus is directed to a thermoplastic sidewall forming one surface of a concrete form. The sidewall incorporates a drainage tile as an integral unit. Two of the sidewalls combined can provide a form for a concrete footer to be poured and remain as a permanent part of the structure.

U.S. Pat. No. 5,065,561 to Mason deals with a concrete wall form system including a plurality of first and second panels each preferably having grooved portions extending along corresponding top side edges and complementary mating tongue portions extending along corresponding bottom side edges, and having regularly spaced transverse slots extending into the top and bottom side edges thereof The form system also includes a plurality of ties each having a bridging web portion, interior flanges formed at the opposite extremities of the web portions, and fastening portions also formed at each end of the web portion and including an outwardly extending shank terminating in an outer flange, the shanks of the fastening portions being adapted for disposition in the aligned transverse slots in vertically adjacent form panels, the interior flanges engaging an interior wall of the panels, and the exterior flanges engaging an outer side wall of the panels. In accordance with the present invention each horizontal row of ties holds together both the top edges of one course of panels and the bottom edges of another course of panels disposed immediately thereabove.

It can thus be seen from the foregoing that several attempts have been made to provide structural reinforcements for concrete forms, some of which address the problem of retaining rebar within the form. The patent to Parker, in particular, shows dimpled grooves in which rebar may be constrained or retained. Unfortunately, none of the known apparatus provide for positive retention of reinforcing materials. Consequently, reinforcing material such as rebar is subject to undesirable movement either before or during the concrete pour. Improper concrete reinforcing can lead to failure of the completed structure. Clearly, the need exists for a simple, inexpensive mechanism associated with a form brace for positively retaining reinforcing materials within a concrete form without diminishing the effectiveness of the functionality of the brace itself.

All patents, patent applications, provisional patent applications and publications referred to or cited herein, are incorporated by reference in their entirety to the extent they are not inconsistent with the teachings of the specification.

BRIEF SUMMARY OF THE INVENTION

A brace for concrete forms employing first and second form elements includes at least one attachment member adapted and constructed to secure the brace to at least one of the form elements. A span member is connected to the at least one attachment member, and has a length sufficient to hold the first and second form elements apart. At least one article securing mechanism is movable between a first position in which the securing mechanism receives an article associated with the concrete form, and a second position in which the securing mechanism secures the article associated with the concrete form to the brace.

BRIEF DESCRIPTION OF THE SEVERAL VIEWS OF THE DRAWING

FIG. 15 illustrates a side elevational view of another preferred embodiment of a brace in accordance with the principles of the present invention.

FIG. 16 illustrates a top plan view of the FIG. 15 brace.

FIG. 17 illustrates a front elevational view of the FIG. 15 brace.

DETAILED DESCRIPTION OF THE INVENTION

Figure 1:
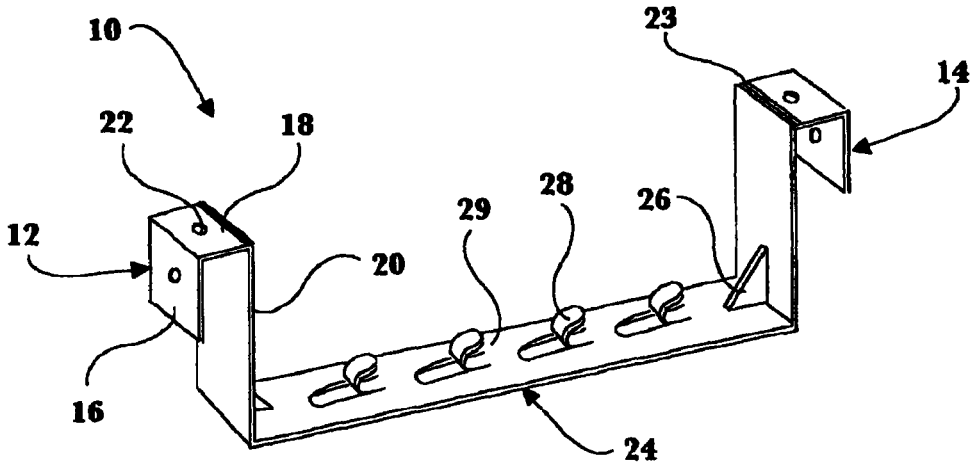
FIG. 1 illustrates a perspective view of a brace in accordance with the principles of the present invention.
Figure 2:
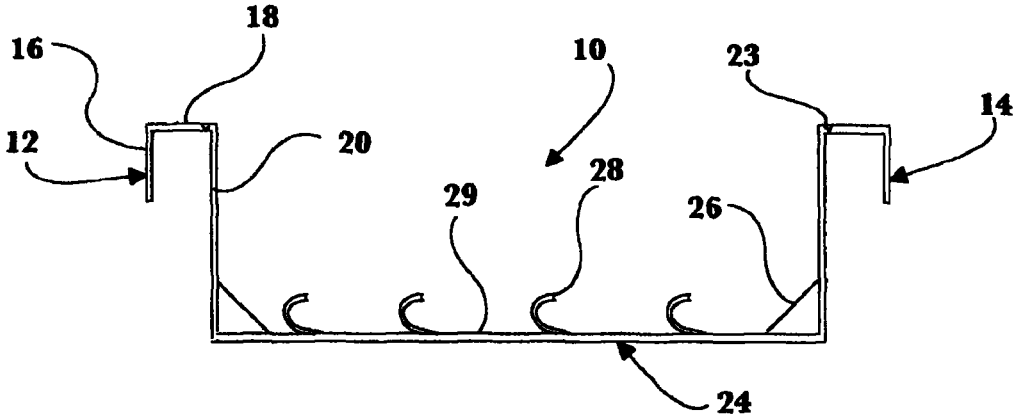
FIG. 2 illustrates a side elevational view of the FIG. 1 brace.
Figure 3:
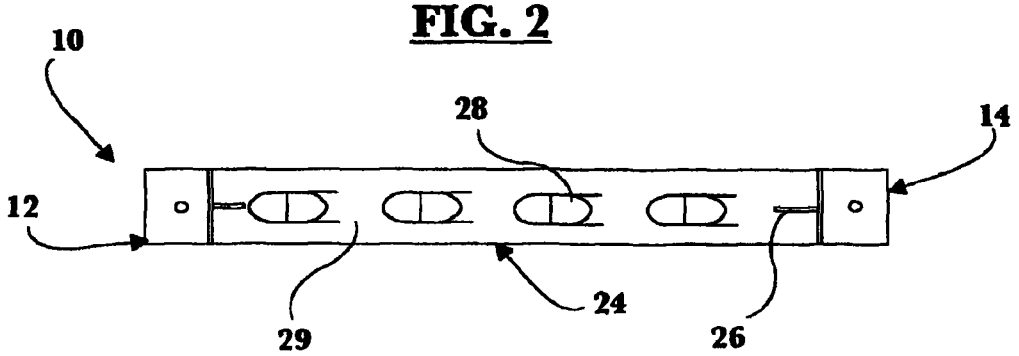
FIG. 3 illustrates a top plan view of the FIG. 1 brace.

FIGS. 1 through 3 illustrate a brace 10 in accordance with the principles of the present invention. The brace 10 includes at least one attachment member, here shown as a pair of opposed attachment members 12, 14. In the illustrated configuration, each of the attachment members 12, 14 is generally rectilinear, and encompasses a connection portion 16, a cross portion 18, and a support portion 20. Fastener apertures 22 can be provided in the connection portion 16 and the cross portion 18 to accommodate the installation of fasteners. The attachment members 12, 14 are adapted and constructed to secure the brace 10 to concrete form elements such as planks. Score lines 23 are provided to permit breaking off of the attachment members 12, 14 after the concrete form has cured, if desired.

A span member 24 extends between the attachment members 12, 14. The span member 24 has a length sufficient to hold the first and second form elements apart for standard concrete form widths. For example, with foundation footings, the distance can range from 4" to 48" or more. With sidewalk or patio slabs, the width can be up to 10 feet or more. A pair of brackets 26 are secured to the attachment members 12, 14 and the span member 24 to enhance the structural integrity of the brace 10.

A plurality of article securing mechanisms 28 extend from a generally horizontal planar surface 29 of the span member 24. In the illustrated example, the article securing mechanisms 28 are shown in a first position in which the securing mechanism 28 receives an article associated with the concrete form. Such articles can include, but are not limited to, rebar, mesh, conduits, or other articles that may be desirable to embed into the concrete structure being formed.

The brace 10 can be formed in any suitable manner from any suitable material. In the embodiment illustrated in FIGS. 1-3, the brace 10 can be fabricated from a single elongated blank of relatively malleable yet rigid material, such as galvanized steel. The attachment members 12, 14 and span member 24 can be formed by bending and/or stamping the blank at right angles as shown. The securing mechanisms 28 can be formed by first stamping or cutting a "horseshoe" shape from the blank, then bending the inside portion of the horseshoe into a shape as shown. It is also contemplated that the brace 10 could be fabricated using other techniques, such as casting or injection molding, and fabricated from a variety of materials, such as plastic.

Figure 4:
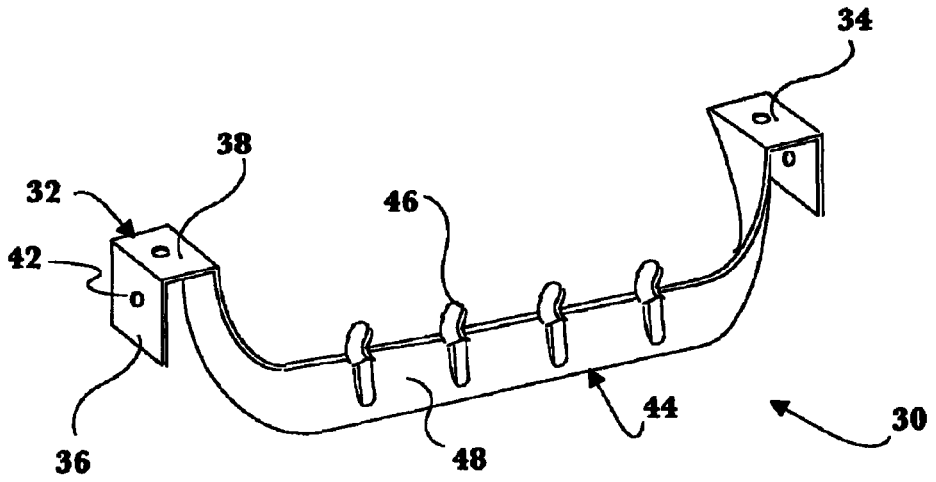
FIG. 4 illustrates a perspective view of another embodiment of a brace in accordance with the principles of the present invention.
Figure 5:
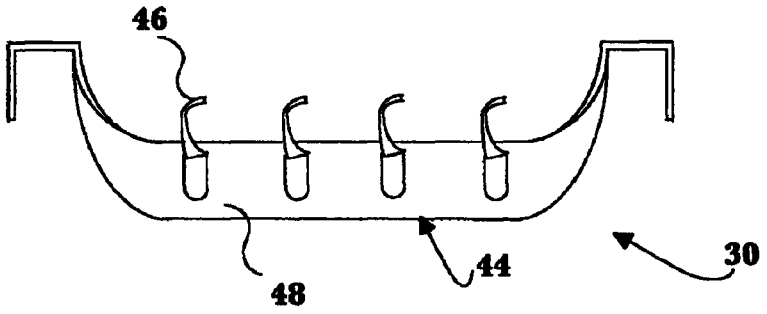
FIG. 5 illustrates a side elevational view of the FIG. 4 brace.
Figure 6:
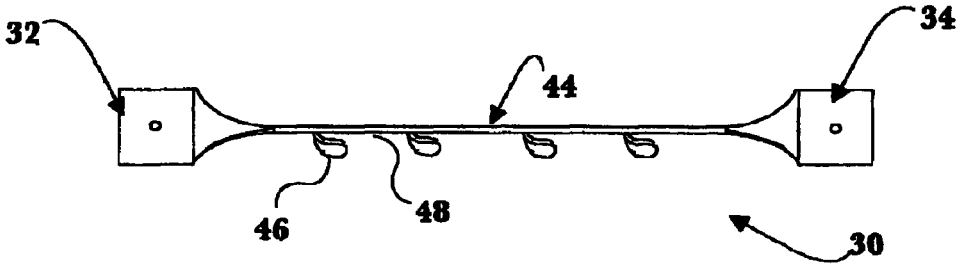
FIG. 6 illustrates a top plan view of the FIG. 4 brace.

FIGS. 4 through 6 illustrate another embodiment of a brace 30 in accordance with the principles of the present invention. The brace 30 includes at least one attachment member, here shown as a pair of opposed attachment members 32, 34. In the illustrated configuration, each of the attachment members 32, 34 is generally rectilinear, and encompasses a connection portion 36, a cross portion 38, and a support portion 40. Fastener apertures 42 can be provided in the connection portion 36 and the cross portion 38 to accommodate the installation of fasteners as desired. The attachment members 32, 34 are adapted and constructed to secure the brace 30 to concrete form elements such as planks, as will be described in detail.

A span member 44 extends between the attachment members 32, 34. The span member 34 has a length sufficient to hold the first and second form elements apart for standard concrete form widths, as described previously.

A plurality of article securing mechanisms 46 extend from a generally vertical planar surface 48 of the span member 44. In the illustrated example, the article securing mechanisms 46 are shown in a first position in which the securing mechanism 46 receives an article associated with the concrete form. Such articles can include, but are not limited to, rebar, mesh, conduits, or other articles that may be desirable to embed into the concrete structure being formed.

The brace 30 can be formed in any suitable manner from any suitable material. In the embodiment illustrated in FIGS. 4-6, the brace 30 can be fabricated from a single elongated blank of relatively malleable yet rigid material, such as galvanized steel. The attachment members 32, 34 and span member 44 can be formed by bending and/or stamping the blank at various angles as shown. The span member 44 is bent or otherwise formed so as to present its vertical surface 48. The securing mechanisms 46 can be formed by first stamping or cutting a "horseshoe" shape from the blank, then compoundly bending the inside portion of the horseshoe into a shape as shown. It is also contemplated that the brace 30 could be fabricated using other techniques, such as casting or injection molding, and fabricated from a variety of materials, such as plastic.

Figure 7:
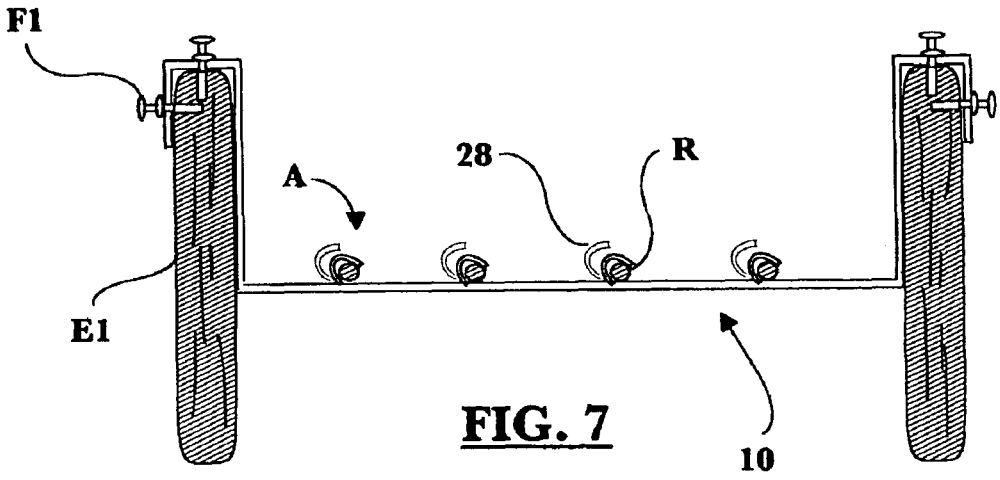
FIG. 7 illustrates a side elevational view of the FIG. 1 brace with rebar in place.

As shown in FIG. 7, the brace 10 is secured between a pair of form elements E1, E2 with a plurality of fasteners F1, such as duplex nails. In most applications, it will be desirable to employ a plurality of braces to secure the forms around the entire structure. With the brace 10 secured, the securing mechanisms are in their first positions, shown in broken line. Articles such as rebar R are placed in the securing mechanisms 28, which are then moved in the direction of arrow A to their second, securing positions, shown in solid line. The rebar R is thus secured against undesirable displacement before, during, and after the concrete pour.

Figure 8:
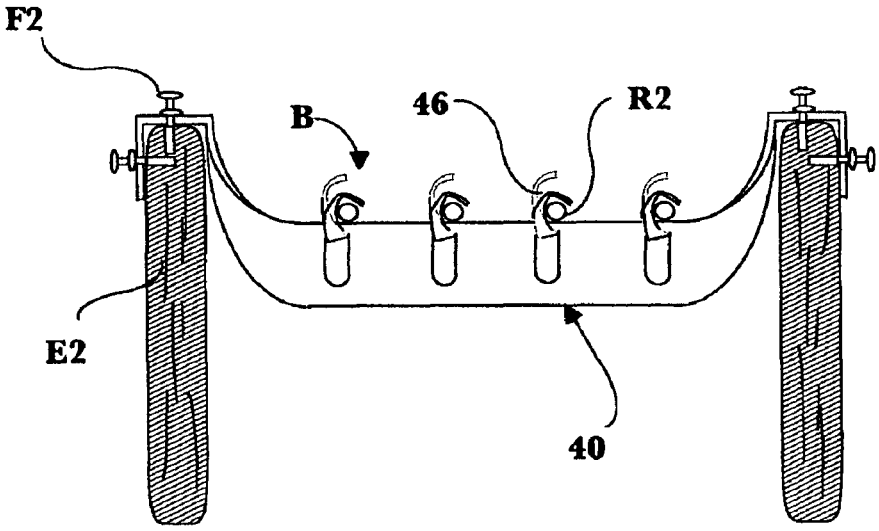
FIG. 8 illustrates a side elevational view of the FIG. 4 brace with rebar in place.

FIG. 8 shows the brace 40 secured between a pair of form elements E3, E4 with a plurality of fasteners F3, such as duplex nails. In most applications, it will be desirable to employ a plurality of braces to secure the forms around the entire structure. With the brace 40 secured, the securing mechanisms are in their first positions, shown in broken line. Articles such as rebar R2 are placed in the securing mechanisms 46, which are then moved in the direction of arrow B to their second, securing positions, shown in solid line. The rebar R2 is thus secured against undesirable displacement before, during, and after the concrete pour.

Figure 9:
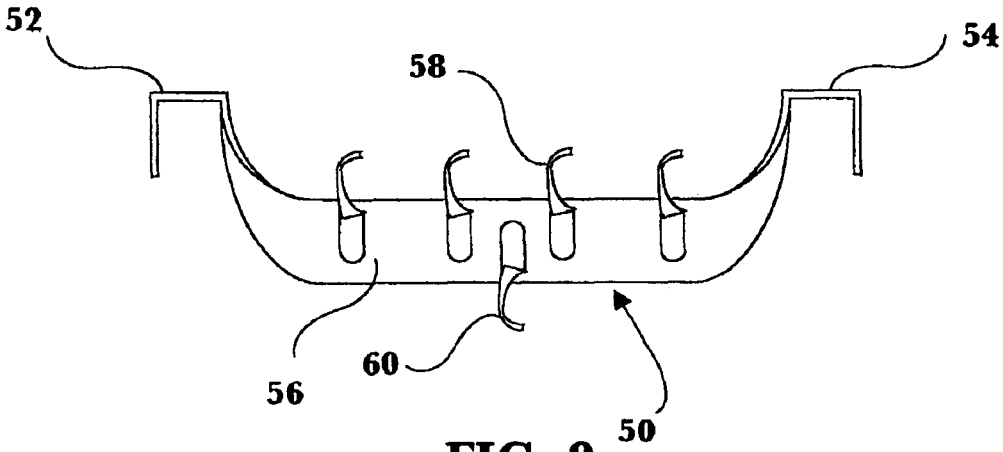
FIG. 9 illustrates a side elevational view of another embodiment of a brace in accordance with the principles of the present invention.

In FIG. 9, another embodiment of a brace 50 in accordance with the principles of the present invention is shown. The brace 50 includes at least one attachment member, here shown as a pair of opposed attachment members 52, 54. A span member 56 extends between the attachment members 52, 54. A plurality of article securing mechanisms 58, 60 extend from a generally vertical planar surface 62 of the span member 56. In the illustrated example, the article securing mechanisms 58 extend in a first direction above the span member 56, and the article securing mechanism 60 extends in a second direction, below the span member 56. In this way, diverse articles can be secured in diverse locations on the brace 60. It is also contemplated that a brace can be constructed similar to that shown in FIGS. 1-3, with the addition of one or more vertically oriented planar surface extending either downwardly or upwardly from the edges of the span member. In such a configuration, securing mechanisms could be formed in both vertical and horizontal surfaces, depending on the articles to be retained. Further, securing mechanisms can also be provided on other portions of the brace, for example, stake holder extensions can be provided on the attachment members to help secure the form elements.

Figure 10:
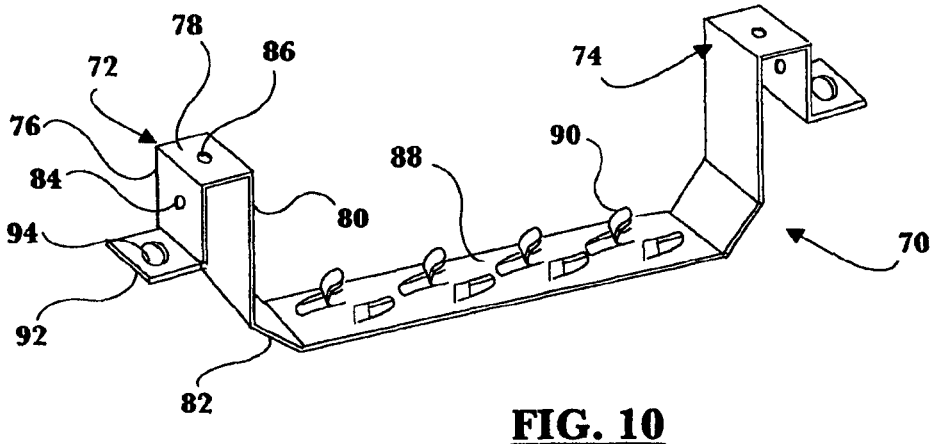
FIG. 10 illustrates a perspective view of another embodiment of a brace in accordance with the principles of the present invention.
Figure 11:
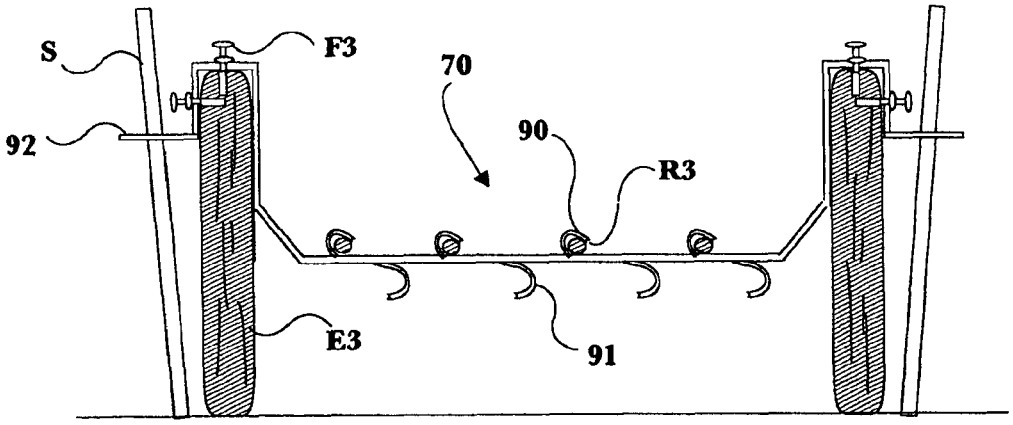
FIG. 11 illustrates a side elevational view of the FIG. 10 brace, top-mounted and with rebar in place.
Figure 12:
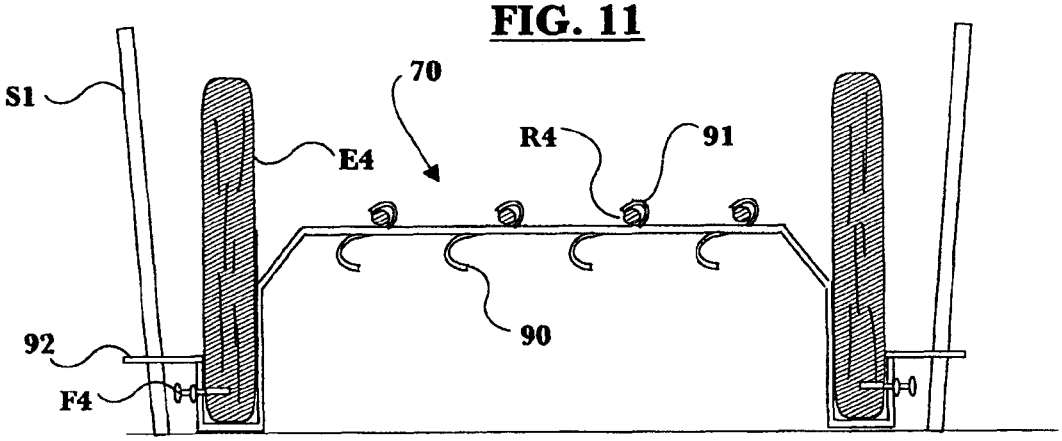
FIG. 12 illustrates a side elevational view of the FIG. 10 brace, bottom-mounted and with rebar in place.
Figure 13:
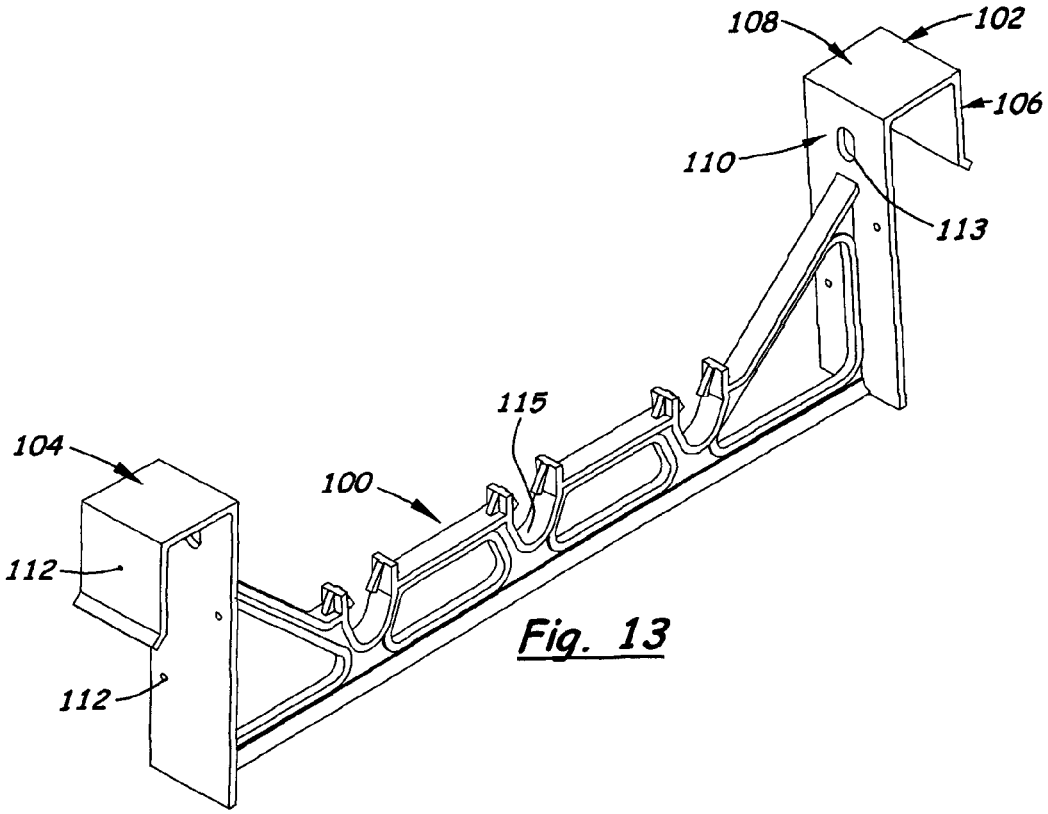
FIG. 13 illustrates a front perspective view of another preferred embodiment of a brace in accordance with the principles of the present invention.
Figure 14:
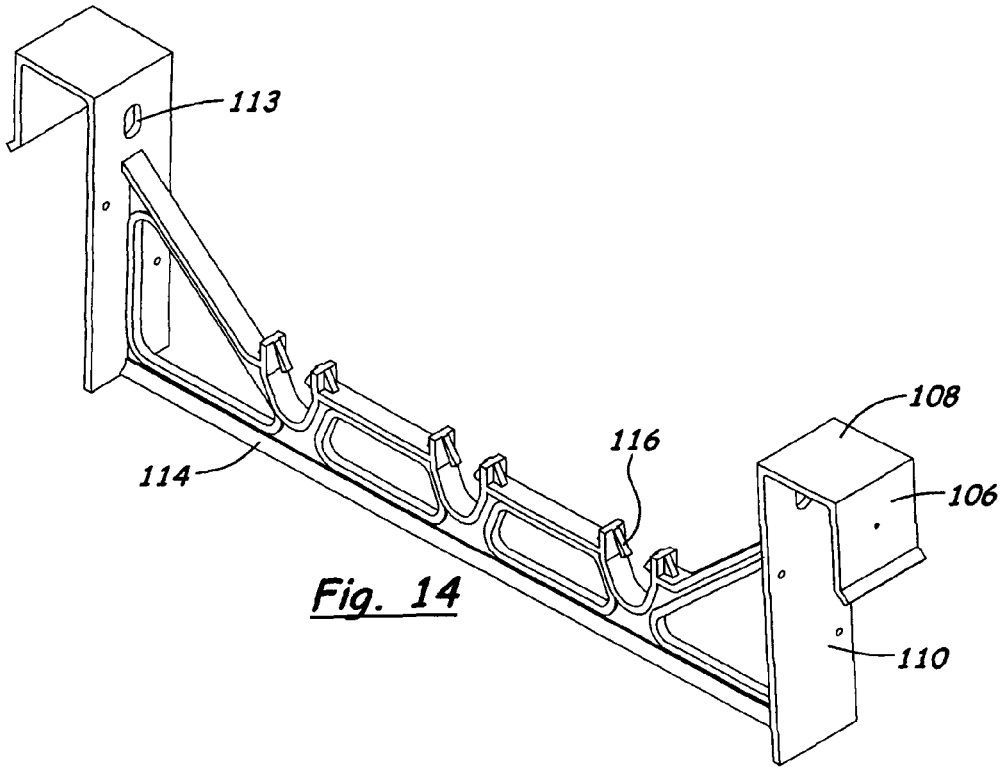
FIG. 14 illustrates a rear perspective view of the FIG. 13 brace.
Figure 18:
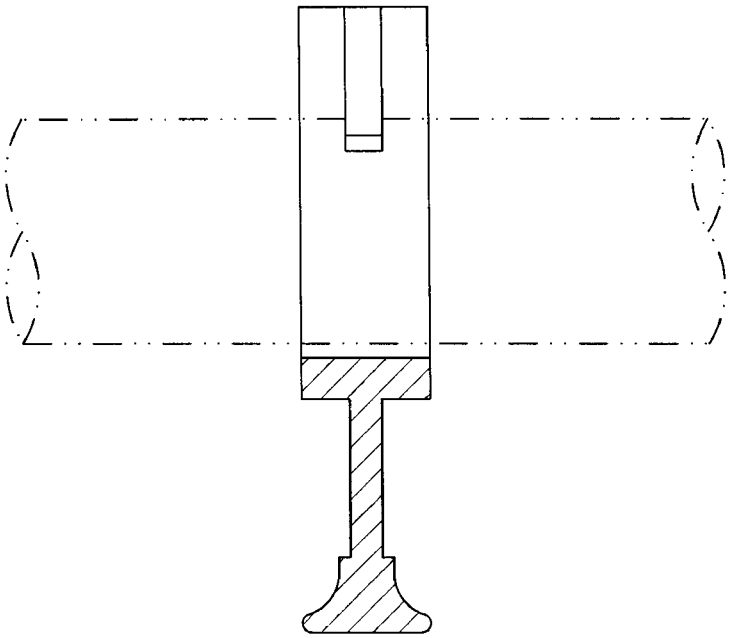
FIG. 18 illustrates a cross-sectional view along line 6-6 of FIG. 15.
Figure 19:
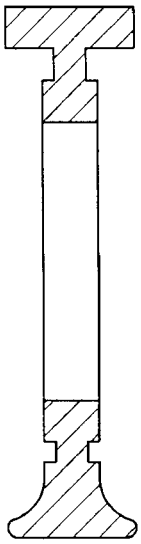
FIG. 19 illustrates a cross-sectional view along line 7-7 of FIG. 15.

FIGS. 10 through 12 illustrate another embodiment of a brace 70 in accordance with the principles of the present invention. The brace 70 includes at least one attachment member, here shown as a pair of opposed attachment members 72, 74. In the illustrated configuration, each of the attachment members 72, 74 is generally rectilinear, and encompasses a connection portion 76, a cross portion 78, a support portion 80, and an angled portion 82. Fastener apertures 84, 86 are provided on the attachment members 72, 74 to accommodate the installation of fasteners, as previously described. A span member 88 extends between the attachment members 72, 74. A plurality of article securing mechanisms 90, 91 extend from opposing surfaces of a generally horizontal planar surface of the span member 88. This placement allows the brace 70 to be "reversible", as will be described. A pair of brackets 92 extend outwardly from the attachment members 72, 74. Each of the brackets 92 includes a stake aperture 94. The brackets 92 can extend from the attachment members 72, 74 at any desired angle. It is contemplated that configuring the brackets 92 at an acute angle will assist in retaining stakes within the brackets 92. As with the previously-described embodiments, the brace 70 can be formed in any suitable manner from any suitable material.

As shown in FIG. 11, the brace 70 is secured between a pair of form elements E5, E6 with a plurality of fasteners F3, such as duplex nails. In most applications, it will be desirable to employ a plurality of braces to secure the forms around the entire structure. Articles such as rebar R3 are shown within the securing mechanisms 90 of the brace 70 in their securing positions, shown in solid line. A pair of stakes S extend through the brackets 92 to provide additional stability to the form.

FIG. 12 illustrates the brace 70 secured between a pair of form elements E6. As opposed to the previous embodiments in which the braces are mounted on the tops of the form elements, the brace 70 is shown mounted on the bottoms of the form elements E6. This mounting arrangement may be desirable due to dimensional constraints or other concerns. The brace 70 is secured with a plurality of fasteners F4, such as duplex nails. Rebar R4 is secured within the securing mechanisms 91 as with the previous embodiments. A pair of stakes S1 extend through the brackets 92 to provide additional stability to the form.

FIGS. 13-24 illustrate other embodiments of a brace 100 in accordance with the principles of the present invention. The brace 100 includes at least one attachment member, here shown as a pair of opposed attachment members 102, 104. In the illustrated configurations, each of the attachment members 102, 104 is generally rectilinear, and encompasses a connection portion 106, a cross portion 108, and a support portion 110. The opposing attachment members of the illustrated embodiment provide parallel, vertical positioning of the form boards.

Fastener apertures 112 can be provided in the connection portion 106, the cross portion 108, and the support portion 110, to accommodate the installation of fasteners as desired. An enlarged hole 113 in the support portion 110 opposes an aperture 112 in the connection portion 106. The enlarged hole offers an opening in which a fastener, such as a nail or screw, driven through the aperture 112 can exit the form board without hitting and possibly shattering the support portion. In a particularly preferred embodiment, apertures 112 are provided on the connection portion 106 as well as the support portion 110. Apertures on the support portion 110 allow the brace to stay connected to the form board if, for example, the cross portion 108 and connection portion 106 snap off in the cold or if these portions are removed to stack or splice form boards.

The attachment members 102, 104 are adapted and constructed to secure the brace 100 to concrete form elements such as planks. In a preferred embodiment, the attachment members 102, 104 are configured to retain the form boards by spring retention. One skilled in the art would recognize that there are a variety of means to create retention force between the connection member 106 and the support member 110. A flare 117 at the terminal end of the connection portion provides a mechanical guide to assist in spreading the connection member 106 from the support member 110 for ease of installation of the brace onto the form board. Form retention means 105 provide an alternate or additional means of form board retention. In the illustrated configuration (FIG. 15) the retention means is a plurality of teeth positioned to grab and hold a plank placed in the attachment member. One skilled in the art would recognize that there are a variety of retention means applicable to the subject brace including, but not limited to, a single tooth, hooks and barbs.

A span member 114 extends between the attachment members 102, 104. The span member 114 has a length sufficient to hold the first and second form elements apart for standard concrete form widths, as described previously. In the illustrated configuration, the span member abuts a braced framework or reverse trestle. The framework adds strength and rigidity to the brace but is open so to not disrupt the flow of concrete. A plurality of saddles 115 in the framework capture articles associated with concrete forms, such as rebar.

Figure 21B:
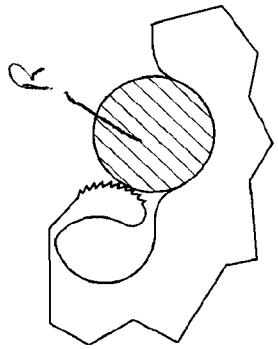
FIG. 21B illustrates the article securing mechanism of FIG. 21A holding rebar.
Figure 21A:
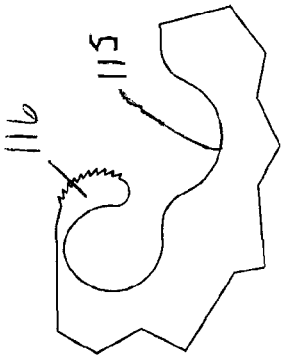
FIG. 21A illustrates a sectional view of another preferred embodiment of an article securing mechanism on the brace in accordance with the principles of the present invention.
Figure 20:
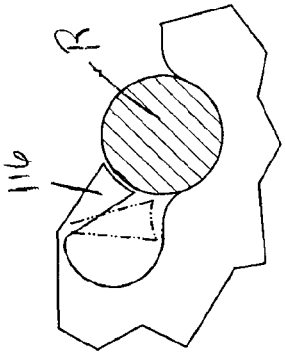
FIG. 20 illustrates a sectional view of a preferred embodiment of an article securing mechanism holding rebar in a brace in accordance with the principles of the present invention.

A plurality of article securing mechanisms 116 extend from a generally horizontal planar surface 118 of the span member 114 and its framework. In the illustrated example, the article securing mechanisms 116 are resilient fingers positioned above the seat of a saddle in the span member. As an article associated with concrete forms, for example, a piece of rebar, is dropped into the saddle 115, the resilient fingers part allowing the rebar to pass, then return to their original position partially obstructing the saddle opening to prevent the rebar from washing out of the saddle when the concrete is poured. In the illustrated configuration the fingers are directed into the saddle to increase retention of the rebar. The overall shape of each finger is further triangular with the apex of the triangle attached to the span. The triangular shape offers strength and resiliency so that fingers 116 do not snap off in the cold or snap from the force of the dropped rebar. In a particularly preferred embodiment, the base of the triangular fingers are dished to contact and hold the shape of the rebar (FIG. 20). The camming action of the fingers have an automatic centering effect on the rebar, enhancing retention. One skilled in the art would realize that a variety of retention means would be applicable to the brace of the subject invention. An example of such means is shown, but not limited to, the means shown in FIG. 21. FIG. 21A shows the fingers 116 have teeth. A camming feature captures and holds the rebar R (FIG. 21B). Alterations to the saddles 115 likewise can assist in holding the rebar in place. For example, the saddles can be corrugated, also the saddles can be sloped progressively to receive varying diameters of rebar. Further, although the illustrated example shows the saddles at the center of the span, saddles can be positioned at any spot along the span as well as under the span. A system in which saddles are removable would add flexibility allowing the proper saddle number and positions to be customized for the job.

Figure 22B:
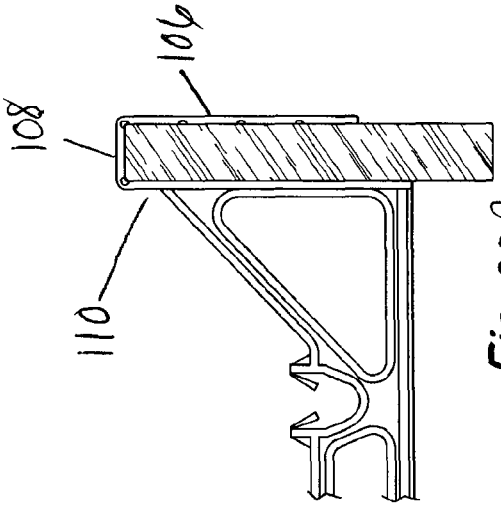
FIG. 22B illustrates the attachment member of FIG. 22B on a form board.
Figure 22A:
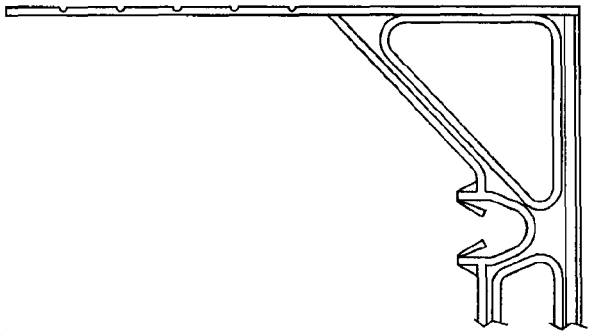
FIG. 22A illustrates a sectional view of another preferred embodiment of an attachment member on a brace in accordance with the principles of the present invention.
Figures 23A, 23B, 23C, 24:
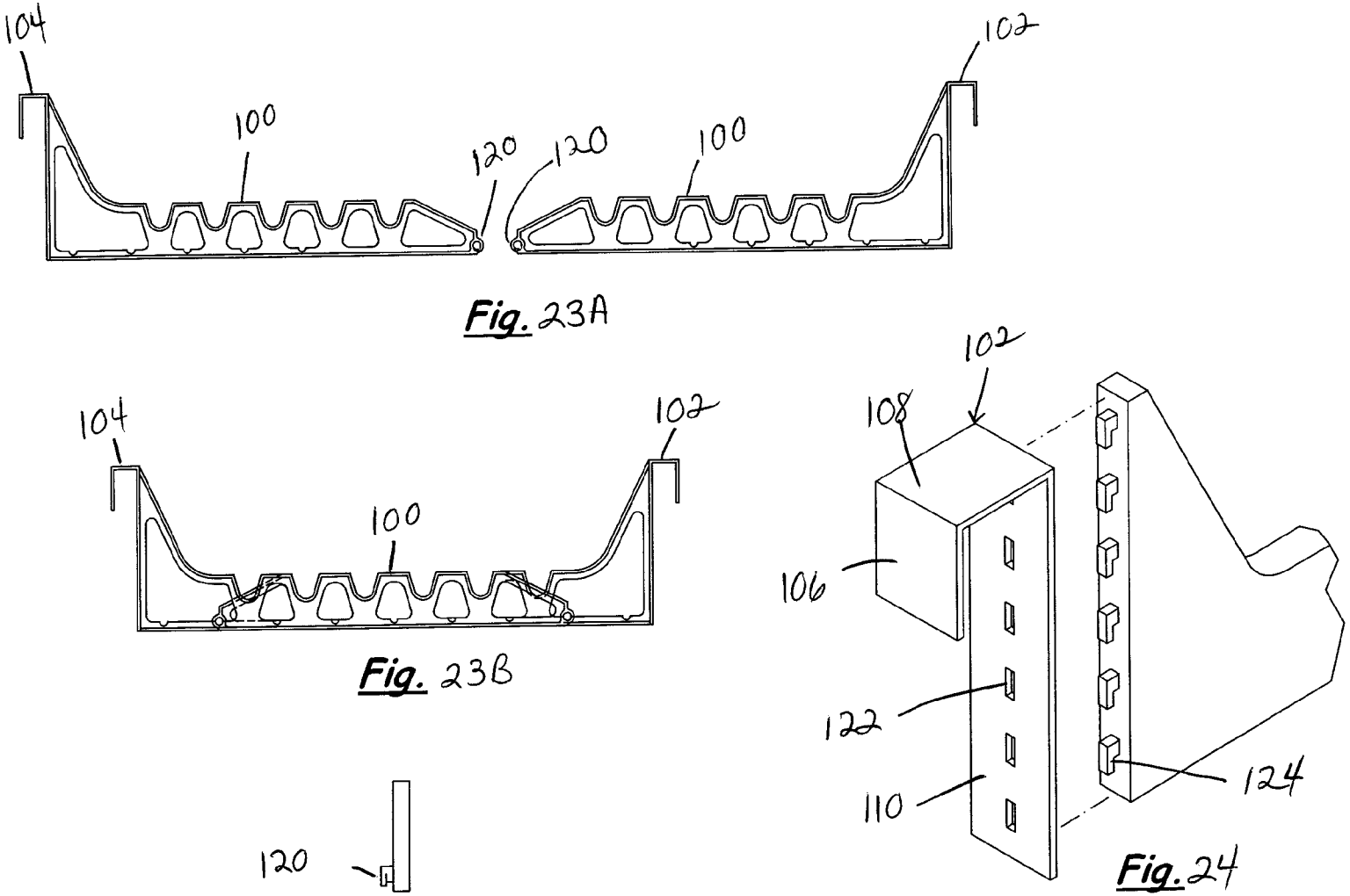
FIG. 23A illustrates a side elevational view of another preferred embodiment of a brace in accordance with the principles of the present invention.
FIG. 23B illustrates the brace of FIG. 23A where the two pieces are attached.
FIG. 23C illustrates a sectional view of the locking means of FIG. 23A and FIG. 23B.
FIG. 24 illustrates a sectional view of another preferred embodiment of an attachment member on a brace in accordance with the principles of the present invention.

FIGS. 22-24 show alternative embodiments of the brace of the subjection invention that allow the brace to be fitted and used to create a variety of forms. The brace of the subject invention vertically and parallely retains form boards for pouring horizontal concrete footings and slabs. An attachment member captures and holds a form board vertically. An opposing board is held parallel to the first form board by the attachment member across the span. The required length of the span will differ with the project. The subject brace can be used when creating a 12 inch wide foundation footing for a building or a three foot wide sidewalk. Different braces can be constructed to accommodate these different applications. Alternatively, a brace member can be provided that has an adjustable span length. In an exemplified embodiment shown in FIG. 23 the brace comprises two identical pieces each having an attachment means 102, 104 partial span 100, and a locking means 120. Locking means rigidly secure one piece to another at a variety of location along the span. Locking means 120 can be as simple as the snap hook shown in the exemplified embodiment and need only provide sufficient rigidity to the span to withstand the flow of concrete. Two pieces are joined by the locking means to provide a brace with variable span widths. If required, a third center piece can snap into each end piece to provide additional length.

A concrete slab's strength is directly related to the position of the reinforcing materials position relative to the concrete top and bottom. Slab and footing widths vary with the width of the form boards used. It is therefore advantageous to be able to adjust the position of the span 100 relative to the cross portion 108 of the attachment member 102 so that reinforcing materials are positioned properly in the concrete whether a 2×6" board is being used as the form or a 2×10" board is being used as the form. One skilled in the art would recognize that this can be accomplished in a variety of ways. FIGS. 22 and 24 suggest two ways this adjustment could be accomplished. FIG. 22 provided an attachment member 102 wherein the cross portion 108 is chosen from a variety of scored sections on a single strap so that the span member is suspended within the form to provide proper placement of the rebar within the poured concrete. The chosen section is bent over the top of the form board and the connection member and the support member are affixed to the form board with, for example, a nail or a screw. In an alternative embodiment, the span member 100 can connect along the support portion 110 to position rebar within the form (FIG. 24). Fissures 122 in the support portion 110 of the attachment member 102 capture hooks 124 on the span member 100 allowing the span member to be placed at the appropriate height within the concrete. One skilled in the art would recognize there are a number of suitable ways to connect the span member along the support portion of the attachment member. These means must hold the connection with sufficient stability to withstand the forces of pouring concrete.

It is contemplated that various features and details are interchangeable within the context of the disclosed invention. For example, any of the embodiments can be provided with stake brackets, or mounted on the bottoms of the form elements. Although the present invention has been described with reference to specific embodiments, those of skill in the art will recognize that changes may be made thereto without departing from the scope and spirit of the invention as defined by the appended claims.

We claim:

1. A brace for concrete forms employing first and second form elements creating edges for a concrete product, the brace comprising the following:

a first rectilinear attachment member, the first attachment member comprising a connection portion, a cross portion and a support portion, the connection portion comprising a first end and a second end, a first end of the cross portion projecting from the second end of the connection portion, a first end of the support portion projecting from the second end of the cross portion, wherein the connection portion and the support portion are near parallel;

a second rectilinear attachment member, the second attachment member comprising a connection portion, a cross portion and a support portion, the connection portion comprising a first end and a second end, a first end of the cross portion projecting from the second end of the connection portion, a first end of the support portion projecting from the second end of the cross portion, wherein the connection portion and the support portion are near parallel;

a span member, a first end of the span member connected to the second end of the support portion of the first rectilinear attachment member, and a second end connected to the second end of the support portion of the second rectilinear attachment member, the span member having a length sufficient to hold the first and second form elements apart; and at least one article securing mechanism in the form of a saddle disposed on the span member, the at least one article securing mechanism having at least two resilient fingers positioned above a seat of the saddle and movable between a first position in which the securing mechanism receives an article associated with the concrete form, and a second position in which the securing mechanism secures the article associated with the concrete form to the brace, said at least two fingers are attached to said span member and the surface of the fingers have teeth;

wherein the first rectilinear attachment member is adapted and constructed to secure the brace to the first form element and the second rectilinear attachment member is adapted and constructed to secure the brace to the second form element, and wherein the brace suspends the article associated with the concrete form in the concrete form so that the article is embedded in the concrete product.

2. The brace of claim 1, wherein said span is a braced framework.

3. The brace of claim 1, wherein said first rectilinear attachment member is adapted and constructed to secure said brace to said first form element and said second rectilinear attachment member is adapted and constructed to secure said brace to said second form element by spring tension.

4. The brace of claim 1, wherein said brace further comprises form retention means.

5. The brace of claim 4, wherein said form retention means is at least one tooth.

6. The brace of claim 3, wherein said first end of said connection portion of said first rectilinear attachment member is flared to provide mechanical assistance in spreading said connection portion from said support portion to secure said first rectilinear attachment member to said first form element and said first end of said connection portion of said second rectilinear attachment member is flared to provide mechanical assistance in spreading said connection portion from said support portion to secure said second rectilinear attachment member to said second form element.

7. The brace of claim 1, wherein said resilient fingers positioned above said seat of said saddle are inclined toward said seat.

8. The brace of claim 1, further comprising apertures in at least one of said connection portion, said cross portion, and said support portion of at least one of said first rectilinear attachment member and said second rectilinear attachment member.

9. The brace of claim 8, wherein said apertures are in said connection portion and said support portion of at least one of said first rectilinear attachment member and said second rectilinear attachment member.

10. The brace of claim 1, further comprising an enlarged hole in said support portion opposing an aperture in said connection portion of at least one of said first rectilinear attachment member and said second rectilinear attachment member.

11. The brace of claim 1, wherein said first attachment member and said second attachment member are a strip scored to create a plurality of sections along a length of the strip, and wherein said strip is bend about one of said sections to create said connection portion, said cross portion and said support portion of said first attachment member and said second attachment member.

12. The brace of claim 1, wherein said span member releasably connects to said support portion of said first attachment member and said second attachment member to allow said span to be positioned relative to said cross portion of said first attachment member and said second attachment member.

13. A brace for concrete forms employing first and second form elements creating edges for a concrete product, the brace comprising the following:

a first rectilinear attachment member, the first attachment member comprising a connection portion, a cross portion and a support portion, the connection portion comprising a first end and a second end, a first end of the cross portion projecting from the second end of the connection portion, a first end of the support portion projecting from the second end of the cross portion, wherein the connection portion and the support portion are near parallel;

a second rectilinear attachment member, the second attachment member comprising a connection portion, a cross portion and a support portion, the connection portion comprising a first end and a second end, a first end of the cross portion projecting from the second end of the connection portion, a first end of the support portion projecting from the second end of the cross portion, wherein the connection portion and the support portion are near parallel;

a first span member, a first end of the first span member connected to the second end of the support portion of the first rectilinear attachment member;

a second span member, a first end of the second span member connected to the second end of the support portion of the second rectilinear attachment member; and at least one article securing mechanism in the form of a saddle disposed on the at least the first span member or the second span member, the at least one article securing mechanism having at least two resilient fingers positioned above a seat of the saddle and movable between a first position in which the securing mechanism receives an article associated with the concrete form, and a second position in which the securing mechanism secures the article associated with the concrete form to the brace, said at least two fingers are attached to said span member and the surface of the fingers have teeth;

wherein the first rectilinear attachment member is adapted and constructed to secure the brace to the first form element and the second rectilinear attachment member is adapted and constructed to secure the brace to the second form element, and when the first span member is rigidly connected to the second span member the brace has a length sufficient to hold the first and second form elements apart; and wherein the brace suspends the article associated with the concrete form in the concrete form so that the article is embedded in the concrete product.

14. The brace of claim 13, wherein said at least one of said first span member and said second span member is a braced framework.

15. The brace of claim 13, wherein said first rectilinear attachment member is adapted and constructed to secure said brace to said first form element and said second rectilinear attachment member is adapted and constructed to secure said brace to said second form element by spring tension.

16. The brace of claim 13, wherein said brace further comprises form retention means.

17. The brace of claim 16, wherein said form retention means is at least one tooth.

18. The brace of claim 15, wherein said first end of said connection portion of said first rectilinear attachment member is flared to provide mechanical assistance in spreading said connection portion from said support portion to secure said first rectilinear attachment member to said first form element and said first end of said connection portion of said second rectilinear attachment member is flared to provide mechanical assistance in spreading said connection portion from said support portion to secure said second rectilinear attachment member to said second form element.

19. The brace of claim 13, wherein said resilient fingers positioned above said seat of said saddle are inclined toward said seat.

20. The brace of claim 13, further comprising apertures in at least one of said connection portion, said cross portion, and said support portion of at least one of said first rectilinear attachment member and said second rectilinear attachment member.

21. The brace of claim 20, wherein said apertures are in said connection portion and said support portion of at least one of said first rectilinear attachment member and said second rectilinear attachment member.

22. The brace of claim 13, further comprising an enlarged hole in said support portion opposing an aperture in said connection portion of at least one of said first rectilinear attachment member and said second rectilinear attachment member.

23. The brace of claim 13, wherein said first attachment member and said second attachment member are a strip scored to create a plurality of sections along a length of the strip, and wherein said strip is bend about one of said sections to create said connection portion, said cross portion and said support portion of said first attachment member and said second attachment member.

24. The brace of claim 13, wherein at least one of said first span member and said second span member releasably connects to said support portion of said attachment member to allow said span member to be positioned relative to said cross portion of said attachment member.

* * * * *